US006746986B1

(12) United States Patent
Sato et al.

(10) Patent No.: US 6,746,986 B1
(45) Date of Patent: Jun. 8, 2004

(54) PAINTED METAL SHEET FOR PRINTING WITH A SUBLIMATION DYE

(75) Inventors: Masaki Sato, Ichikawa (JP); Kaoru Kojima, Ichikawa (JP); Seiju Suzuki, Ichikawa (JP); Kazuhiko Takahashi, Ichikawa (JP); Hiroshi Entani, Ichikawa (JP)

(73) Assignee: Nisshin Steel Co., Ltd., Tokyo (JP)

( * ) Notice: Subject to any disclaimer, the term of this patent is extended or adjusted under 35 U.S.C. 154(b) by 25 days.

(21) Appl. No.: 09/667,132

(22) Filed: Sep. 21, 2000

(30) Foreign Application Priority Data

Apr. 24, 2000 (JP) ..... 2000-122838
Aug. 22, 2000 (JP) ..... 2000-250599

(51) Int. Cl.[7] ..... B41M 5/035; B41M 5/38
(52) U.S. Cl. ..... 503/227; 428/209
(58) Field of Search ..... 503/227; 8/471; 428/209, 480

(56) References Cited

U.S. PATENT DOCUMENTS 5,024,989 A * 6/1991 Chiang et al. ..... 503/227
5,106,815 A * 4/1992 Akada et al. ..... 503/227

FOREIGN PATENT DOCUMENTS

| | | |
|---|---|---|
| JP | 48-66640 | 9/1973 |
| JP | 51-8128 | 1/1976 |
| JP | 54104907 | 8/1979 |
| JP | 56-8070 | 1/1981 |
| JP | 1-229622 | 9/1989 |
| JP | 02242863 | 9/1990 |
| JP | 51-24313 | 5/1993 |
| JP | 55-5422 | 8/1993 |
| JP | 07031931 | 2/1995 |
| JP | 07102733 | 4/1995 |
| JP | 08183926 | 7/1996 |
| JP | 09206678 | 8/1997 |
| JP | 082957 | 3/2000 |

* cited by examiner

*Primary Examiner*—B. Hamilton Hess
(74) *Attorney, Agent, or Firm*—Webb Ziesenheim Logsdon Orkin & Hanson, P.C.

(57) ABSTRACT

A colored metal sheet useful as a decorative member, a multi-colored signboard, etc. is provided by transfer-printing a topcoat or clear paint layer 4 formed on a substrate metal sheet 1 with a sublimation dye. A basecoat paint layer 2 and a primer paint layer 3 may be formed between the substrate metal sheet 1 and the paint layer 4. A sublimation dye penetrates into the paint layer 4 to form colored parts 5 extending along thickness direction of the paint layer 4. Glass flakes 6 (of 8 μm or less in thickness and 10–70 μm in length) and calcium silicate (of 1–8 μm in primary particle size) may be dispersed in the paint layer 4, to improve slippage-proof property and wear-resistance. Powdery silica (of 0.5–8 μm in particle size) may be dispersed in the paint layer 4, to improve anti-scratching property and wear-resistance. Light-resistance of the paint layer 4 is improved by using a topcoat or clear paint mainly composed of a melamine-containing thermosetting polyester resin having number average molecular weight of 1000–10000 and a glass transition temperature (Tg) of 20–60° C.

8 Claims, 3 Drawing Sheets

PAINTED METAL SHEET FOR PRINTING WITH A SUBLIMATION DYE

BACKGROUND OF THE INVENTION

The present invention relates to a painted metal sheet, on which a printed design full of variety is given with a sublimation dye, for use as a multi-colored signboard, a decorative interior sheet, a decorative surfacing sheet, a door panel for an elevator or an outer panel for electric home appliances or furniture, etc.

Painted metal sheets printed with colorful designs have been manufactured so far by offset, silk, photogravure or transfer-printing. In a conventional transfer-printing method, a sublimation dye is applied to a topcoat or clear paint formed on a painted metal sheet by a proper printing method such as offset, silk, photogravure or transfer. The top clear layer is then impregnated with the sublimation dye by heat treatment. For instance, JP 51-24313A discloses a method wherein a transfer film is heated in contact with a paint layer of thermosetting synthetic resin. JP 54-104907A discloses a method wherein a paint layer printed with a sublimation dye is formed on a metal sheet, a top paint layer is formed on the printed layer, and then the top layer is impregnated with the sublimation dye from the inner side by heat treatment. JP 7-31931A discloses a method wherein a pre-coated metal sheet, which has a primer paint layer and a colored top paint layer, is impregnated with a sublimation dye. JP 7-102733A discloses a method wherein an opaque resin layer formed on a metal sheet is impregnated with a sublimatable coloring agent.

In any case, an objective design appears by penetration of the sublimation dye into the top paint layer. However, a conventional clear paint layer has inferior anti-scratching property(scratch resistance), wear-resistance and slippage-proof (slippage resistance) property, and scratches formed on its surface are apparently distinguished, although it is smooth, glossy and vivid. In this consequence, the printed sheet is not applicable to such a part as a flooring sheet or a table counter, which is used under abrasive conditions.

Anti-scratching property and wear-resistance of a paint layer can be improved by the addition of an inorganic filler. For instance, JP 48-66640A proposes a powdery paint improved in anti-scratching property and wear-resistance by the addition of glass fibers at a ratio of 5–70 wt. %. JP 51-8128A proposes a paint, which contains glass flakes having a thickness of less than 3 $\mu$m and a size passing a sieve of 150 meshes, for a precoated steel sheet improved in anti-scratching property and wear-resistance. JP 8-183926A proposes a painted metal sheet coated with an acrylic resin paint improved in anti-scratching property and wear-resistance by addition of an inorganic filler at a ratio of 5–60 parts by weight based on 100 parts by weight of a solid vehicle in a paint. However, these paint layers are of poor transparency to well intensify a colored design using as a background metallic luster of a substrate metal or a color tone of an undercoat paint layer and also inferior of slippage-proof, although they are good of anti-scratching property and wear-resistance.

A paint layer is also improved in anti-scratching property and wear-resistance by irradiation with an electron beam, as noted in an electron beam-curing acrylic paint (as disclosed in JP 55-5422B, JP 56-8070B, JP 1-229622A and JP 2-242863A). Since a paint layer irradiated with an electron beam has hardness of 9H or harder by a pencil hardness test, it is good of wear-resistance, anti-scratching property and anti-fouling property. However, such an electron beam-curing paint layer is poor of plasticity and relatively expensive, and also needs a special electron beam irradiator for curing the paint layer, resulting in increase of a manufacturing cost. There is also the disadvantage that a paint layer cured with electron beam irradiation is poor of wear-resistance, compared with a thermosetting resin layer.

By the way, vinyl chloride tiles, vinyl chloride panels, etc., which are commonly used as organic flooring materials are difficult to give a multi-colored design with a sublimation dye due to poor dimensional stability and poor heat-resistance. Decorative flooring material, which uses metallic luster of a substrate metal sheet as a background for a multi-colored design, is scarcely offered to the market. Most table counters are made of wood, but multi-colored goods with metallic appearance are scarcely offered to the market.

Multi-colored decorative signboards have been also manufactured so far by a short-lot process wherein a decorative film is individually stuck to a metal sheet or a painted sheet instead of using a sublimation dye. However, such a decorative signboard cannot be used for a long term exceeding a half-year, since the laminated decorative film is easily peeled off. It is also difficult to increase hardness of the decorative film for improvement of anti-scratching property, because of lamination of the decorative film at a final stage of the manufacturing process. In addition, the external appearance of the signboard is significantly influenced by the texture of the decorative film, so that it is impossible to allot color with metallic or ceramic impression.

Coloring concentration of a pattern printed with a sublimation dye is limited to a narrow range due to poor masking ability of the sublimation dye. When a heat is applied to a transfer film during a transfer-printing step, a sublimation dye is often excessively transferred even to an undercoat paint layer or reversely transferred to the transfer film. Such unfavorable transfer of the sublimation dye causes a printed pattern to lack of sharpness especially in case printing characters or the like.

A decorative design is realized by impregnation of a top paint layer with a sublimation dye in any of conventional design-printing methods. However, such a sublimation dye is a dispersion-type or oily type having a small polarity, and is easily degenerated by plasticizers or organic chemicals, and also decomposed by ultraviolet irradiation resulting in discoloration or fading. Due to these unfavorable properties of the sublimation dye, the decorative design is hardly kept in a stable colored state under conditions exposed to open air for a long time. Discoloration or fading caused by ultraviolet irradiation can be inhibited by the addition of a proper ultraviolet-absorbing agent to a paint at a ratio of 0.5–3 wt. % on the basis of a non-volatile component in the paint.

A precoated steel sheet as a substrate for transfer-printing is manufactured by baking an applied paint at 200–240° C. (as a highest temperature of a substrate sheet) for 1–2 minutes, while a paint layer is impregnated with a sublimation dye at 160–190° C. for 1–4 minutes. That is, the ultraviolet-absorbing agent added to the paint is exposed to a high-temperature atmosphere at least two times until a final stage of a printed metal sheet-manufacturing process. A commonly used ultraviolet-absorbing agent such as benzophenone or benzotriazole is quantitatively decreased in the paint layer due to poor resistance to heat and sublimation. The weight loss of the ultraviolet-absorbing agent puts harmful influences on discoloration or fading of the decorative design, but also causes deformation of the paint layer to a yellowish rugged surface. Such yellowish appearance is apparently distinguished, when paint-baking as well as transfer-printing are performed at a higher temperature.

Weight loss of the ultraviolet-absorbing agent is suppressed by the addition of a thermally-stable and well-soluble benzotriazole or triazine compound at a ratio of 6–18 wt. % on the basis of a non-volatile component in a paint, as disclosed in JP 9-206678A. Addition of such a benzotriazole or triazine compound is effective for many kinds of sublimation dyes, but discoloration or fading of some sublimation dyes cannot be suppressed to a level necessary for outdoor application. Although discoloration or fading may be suppressed by using a high-grade sublimation dye for good of light resistance, change of the sublimation dye is not a practical idea because of constraint on aptitude, color tone, etc. of the sublimation dye in correspondence with a type of a printer used for outputting a decorative image. For instance, if only one color ink has poor light-resistance among basic 4 colors (cyanic, magenta, yellow and black), a printed sheet can not be used for outdoor application.

SUMMARY OF THE INVENTION

The present invention is accomplished to overcome the problems as above-mentioned, and aims at provision of a painted metal sheet, to which a multi-colored design can be given without eliminating metallic luster of a substrate metal sheet or a color tone of an undercoat paint layer, and also improved in light-resistance, anti-scratching property, wear-resistance, slippage-proof property and anti-fouling property.

Slippage-proof property and wear-resistance of a transparent or translucent topcoat paint layer are improved by dispersion of glass flakes and calcium silicate in the paint layer. The topcoat paint layer is formed from a paint containing glass flakes at 5–25 wt. % and calcium silicate at 0.5–10 wt. % on the basis of a non-volatile component in the paint. The glass flakes are of 10–70 $\mu$m in average length, while the calcium silicate is of 1–8 $\mu$m in average primary particle size. The topcoat paint layer has a thickness of 5–40 $\mu$m and surface roughness of Ra:1.0–6.0 $\mu$m. A decorative design is given to the topcoat paint layer by impregnation with a sublimation dye.

Anti-scratching property and wear-resistance of a topcoat or clear paint layer are improved by dispersion of powdery silica in the paint layer. Powdery silica of 0.5–8 $\mu$m in average particle size is dispersed in the clear paint layer at a ratio of 1–10 wt. % on the basis of a non-volatile component in the paint, and the clear paint layer is controlled to thickness of 5–40 $\mu$m and 60-degree glossiness of 10–75.

Discoloration and fading of a sublimation dye can be remarkably suppressed by use of a resin good of light-resistance. In this case, a topcoat paint layer is formed from a transparent or translucent paint mainly composed of a thermosetting polyester resin having number average molecular weight of 1000–10000 and a glass transition temperature (Tg) of 20–60° C. and containing melamine at a ratio of 20–150 parts by weight on the basis of 100 parts by weight of a solid component in the paint.

The thermosetting polyester resin may be preferably one which contains a 1,2-benzene-dicarbonyl structure derived from a dicarboxylic acid monomer and/or a 2,2-dimethyl trimethylene structure derived from a di-alcoholic monomer in its molecule.

A triazine and/or benzotriazole ultraviolet-absorbing agent may be added to the topcoat paint preferably at a ratio of 1–22 parts by weight on the basis of 100 parts by weight of a non-volatile component in the paint.

DETAILED DESCRIPTION OF THE INVENTION

Figure 1A:
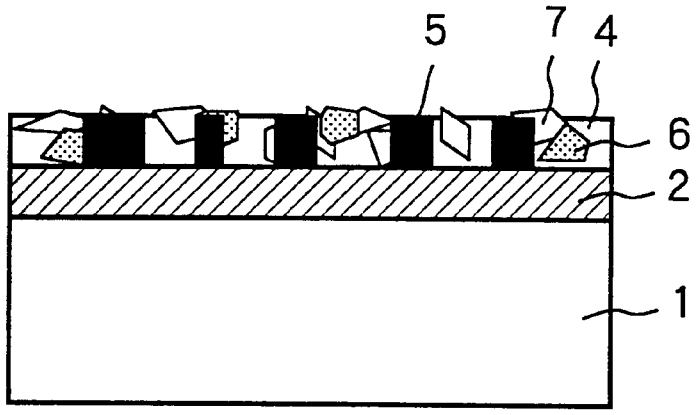
FIG. 1A is a sectional view of a metal sheet coated with a basecoat paint layer and a transparent or translucent paint layer to which a colored design is given by transfer-printing in Example 1.
Figure 1B:
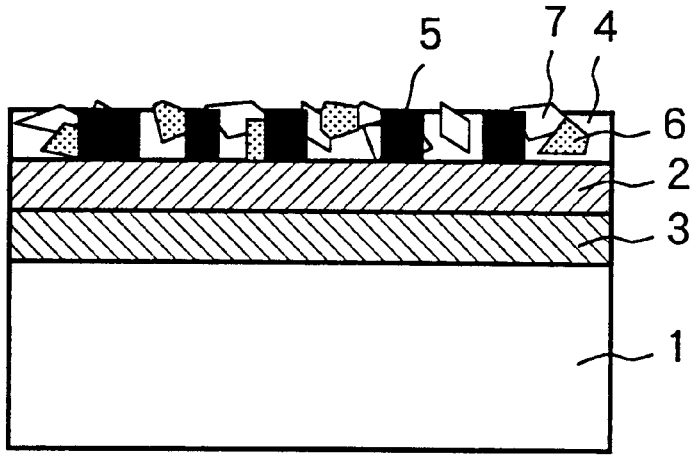
FIG. 1B is a sectional view of a metal sheet coated with a primer layer, a basecoat paint layer and a transparent or translucent paint layer to which a colored design is given by transfer-printing in Example 1.
Figure 1C:
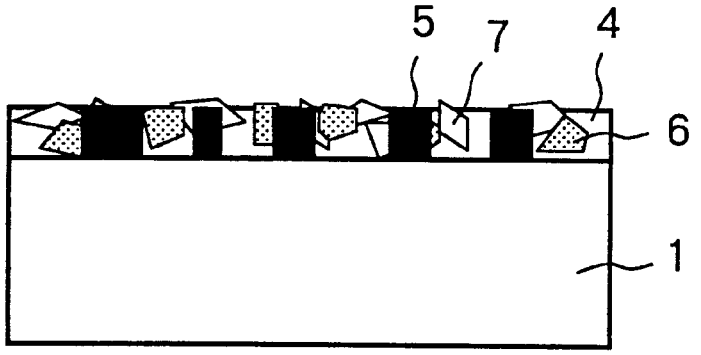
FIG. 1C is a sectional view of a metal sheet directly coated with a transparent or translucent paint layer to which a colored design is given by transfer-printing in Example 1.

The newly proposed painted metal sheet comprises a substrate metal sheet 1 coated with a transparent or translucent topcoat or clear paint layer 4, as shown in FIGS. 1A–1C. A basecoat paint layer 2 and a primer paint layer 3 may be optionally formed between the substrate metal sheet 1 and the topcoat or clear paint layer 4. As far as there is the topcoat or clear paint layer 4 as the uppermost layer, any painted metal sheet, i.e. one (FIG. 1A) having the basecoat paint layer 2 between the metal substrate 1 and the topcoat or clear paint layer 4, another one (FIG. 1B) having the basecoat paint layer 2 and the primer paint layer 3 between the metal substrate 1 and the topcoat paint layer 4, or still another one (FIG. 1C) having the topcoat paint layer 4 directly formed on the metal substrate 1, may be used for transfer-printing a design with a sublimation dye. In any case, metallic luster of the substrate metal sheet 1 or a color tone of the basecoat paint layer 2 or the primer paint layer 3 may be used as a background for the printed design realized by penetration of a sublimation dye into the topcoat or clear paint layer 4.

The basecoat paint layer 2 may be white or colored with a proper tone. When metallic luster of the substrate metal 1 or a color tone of the basecoat paint layer 2 or the primer paint layer 3 is used as a background for an image of a printed design, a topcoat paint for the layer 4 is conditioned to a composition having good transparency. In this sense, the term "topcoat paint layer" includes a clear paint layer. Of course, such a filler as silica may be added to the topcoat paint to realize delustered appearance.

There are not any special restrictions on the kind of the substrate metal 1. For instance, a cold-rolled steel sheet, a galvanized steel sheet, a stainless steel sheet, a copper sheet, an aluminum sheet or the like may be used as the substrate metal 1. In order to realize a design with metallic impression, such a lustrous sheet as a stainless, aluminum or copper sheet is preferably used. The substrate metal sheet 1 is optionally subjected to mechanical polishing, pickling and such chemical conversion treatment as phosphating or chromating in response to a kind and surface condition of the metal sheet 1 before application of an undercoat or topcoat paint, so as to enhance adhesiveness of a paint layer.

A basecoat paint layer 2 and a primer paint layer 3 are optionally formed on the pretreated substrate metal sheet 1 according to an ordinary method.

The basecoat paint layer 2 is preferably of 10–20 μm in thickness to shield the substrate metal sheet 1 or the primer paint layer 3. If the basecoat paint layer 2 is thinner than 10 μm, its shielding effect on the substrate metal sheet 1 or the primer paint layer 3 is too weak to realize an appearance of the paint layer without influences of color tones of the substrate metal sheet 1 and the primer paint layer 3. If the basecoat paint layer 2 is thicker than 20 μm on the contrary, a residual solvent in an applied paint is abruptly vaporized during baking. Such abrupt vaporization causes occurrence of pinhole defects, so-called "bumping", in the paint layer.

A clear paint layer or topcoat paint layer 4 of 5–40 μm in thickness is formed on the substrate metal sheet 1, the basecoat paint layer 2 or the primer paint layer 3. If the clear paint layer or topcoat paint layer 4 is thinner than 5 μm, the painted metal sheet is weak of wear-resistance. If the clear paint layer or topcoat paint layer 4 is thicker than 40 μm on the contrary, a residual solvent in an applied paint is abruptly vaporized during baking. Such abrupt vaporization causes occurrence of "bumping" in the paint layer. An excessively thick clear paint layer 4 is also poor of transparency, so that metallic luster of the substrate metal sheet 1 as well as color tones of the paint layers 2, 3 can not be used as a background for a printed design.

Thickness of the topcoat paint layer 4 is preferably adjusted within a range of 10–25 μm for balancing slippage-proof with wear-resistance. A clear paint layer may be further formed on the topcoat paint layer 4 for such a use as a flooring sheet which will be subjected to severe abrasive conditions. The topcoat paint 4 may be hardened by addition of such a curing agent as melamine, urea or isocyanate.

The topcoat paint layer 4 is made from a resin, which is easily colored due to its affinity with a sublimation dye transferred from a transfer film. In this sense, a thermosetting polyester resin having a number average molecular weight of 1000–10000 and a glass transition temperature (Tg) of 20–60° C. and containing melamine at a ratio of 20–150 parts by weight on the basis of 100 parts by weight of a solid component in the resin is well colored with the sublimation dye, and a realized design also has good storage stability. The thermosetting resin is not too softened at a heating temperature of 150–200° C. during transfer-printing. The thermosetting resin having good heat resistance also effectively inhibits deterioration of the luster of the painted sheet after transfer-printing.

A resin paint for the topcoat paint layer 4 may be a vinyl resin such as polyvinyl alcohol, polyvinylbutyral, polyvinylacetal, polyvinyl acetate, polyvinylchloride, polyvinylpyrrolidone, polystyrene, an acrylic resin such as polymethyl (metha)acrylate, polybutyl (metha)acrylate, polyacrylamide, polyacrylonitrile, a polyester resin, a polycarbonate resin, a polyurethane resin, a polyamide resin, an urea-formaldehyde resin, a polycaprolactone resin, a polyarylate resin, a polysulfone resin, a silicone polyester resin, epoxy resin, or these copolymer or a mixture. Especially, a polyester resin is preferably added as at least one component to the topcoat paint, since it is well colored with the sublimation dye, and a realized design has good storage stability.

A thermosetting polyester resin is synthesized by polycondensation of a dibasic acid with a polyalcohol. The dibasic acid may be aromatic dicarboxylic acid, aliphatic dicarboxylic acid or those acid nonhydrates. For instance, one or more of phthalic anhydride, orthophtalic acid, isophthalic acid, terephthalic acid, maleic acid, maleic anhydride, fumaric acid, adipic acid are used as the dibasic acids. In order to improve light-resistance of the paint layer, the thermosetting polyester resin preferably contains phthalic anhydride and/or orthophtalic acid which forms the 1,2-benzene-dicarbonyl structure. Adipic acid, which does not involve a phenyl group, is also a favorable dibasic acid.

The polyalcohol may be one or more of ethylene glycol, diethylene glycol, triethyleneglycol, propylene glycol, pentyl glycol, neopentylglycol or trimethylolethane. A glycol such as pentyl glycol having a long aliphatic chain is preferred in order to improve light resistance of the paint layer. Especially, neopentylglycol, which forms a 2,2-dimethyl trimethylene structure after polymerization, is a preferred polyalcohol.

Number average molecular weight of the thermosetting polyester resin is adjusted to 1000–10000. If the number average molecular weight is less than 1000, the topcoat paint layer 4 is poor of elongation and plasticity. If the number average molecular weight exceeds 10000, the topcoat paint layer 4 is easily decomposed by ultraviolet irradiation due to decrease of cross-linked parts with the melamine. The melamine as a curing agent is stable as such against ultraviolet irradiation, and effectively improves light-resistance of the polyester resin paint.

The effect of the melamine on light-resistance is distinctly noted by addition of the melamine at a ratio of 20 parts by weight or more. However, excessive addition of the melamine at a ratio more than 150 parts by weight unfavorably increases density of cross-linked parts and causes occurrence of crackings in the paint layer during working. A glass transition temperature (Tg) of the thermosetting polyester resin is adjusted at a value higher than 20° C. to ensure proper hardness of the paint layer for inhibition of crackings. However, a glass transition temperature (Tg) higher than 60° C. makes the paint layer too hard and poor of plasticity.

Glass flakes 6 of 8 μm or less in thickness and 10–70 μm in average length can be dispersed in the topcoat paint layer 4 at a ratio of 5–25 wt. % in order to increase the hardness of the topcoat paint layer 4. On the other hand, if the ratio of the glass flakes 6 is less than 5 wt. %, the topcoat paint layer 4 is softer than F by a pencil hardness test. Insufficient dispersion of the glass flakes also causes dappled ruggedness (i.e. poor external appearance) of the topcoat paint layer 4 due to scattering of the glass flakes on the topcoat paint layer 4. If the glass flakes are dispersed at a ratio more than 25 wt. %, the topcoat layer 4 is opaque and poor of smoothness.

The glass flakes 6 dispersed in the topcoat paint layer 4 are adjusted to a shape of 8 μm or less in thickness and 10–70 μm in length taking into account requisition for the topcoat paint layer and coating operation. On the other hand, if glass flakes thicker than 8 μm are dispersed in the topcoat paint layer 4, the topcoat paint layer 4 is easily cracked when the painted metal sheet is bent and also peeled off the substrate metal sheet 1 due to abrasion. Such thick glass flakes put harmful influences on the coating operation, since they are apt to settle in the topcoat paint. If the glass flakes are longer than 70 μm in average, such longer glass flakes are projected from a surface of the topcoat paint layer 4 and easily dropped out. On the other hand, if the glass flakes are shorter than 10 μm, it is difficult to adjust a surface of the topcoat paint layer 4 to controlled ruggedness more than Ra 1.0 μm.

Calcium silicate 7 of 1–8 μm in average primary particle size is further dispersed in the topcoat paint layer 4. The primary particles of calcium silicate filler to secondary particles of 15–50 μm in the topcoat paint, and the secondary particles are dispersed in the topcoat paint layer 4 to improve slippage-proof. If the calcium silicate is of primary particle size bigger than 8 μm, the secondary particles are apt to sediment in the topcoat paint, resulting in poor coating operability. If the calcium silicate is of primary particle size smaller than 1 μm on the contrary, resultant secondary particles are too small to obtain a slippage-proof topcoat paint layer 4.

Calcium silicate 7 is dispersed in the topcoat paint layer 4 at a ratio of 0.5–10 wt. % (preferably 1.5–5 wt. %). The slippage-proof property of the topcoat paint layer 4 is distinctly noted by dispersion of calcium silicate at a ratio of 0.5 wt. % or more. However, excessive dispersion of calcium silicate at a ratio more than 10 wt. % weakens transparency of the topcoat paint layer 4, so that metallic luster of the substrate metal sheet 1 or a color tone of an undercoat paint layer can not be used as a background for a printed design.

The topcoat layer 4 is preferably adjusted to hardness of 2H or harder as a cured state. The topcoat paint layer 4 can be hardened in short time by addition of such a curing agent as methylated or butylated melamine or a curing catalyst such as a sulfonic compound to cure the topcoat paint layer 4. The topcoat paint layer 4 preferably has a color tone with the highest possible transparency, in the case where metallic luster of the substrate metal sheet 1 or a color tone of an undercoat paint layer is used as a background for a printed design.

Figure 2A:
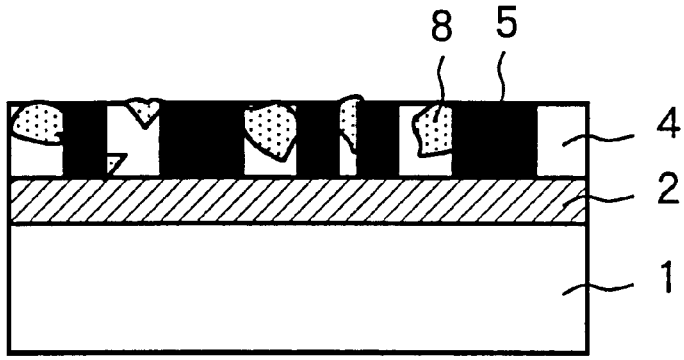
FIG. 2A is a sectional view of a metal sheet coated with a basecoat paint layer and a clear paint layer to which a colored design is given by transfer-printing in Example 3.
Figure 2B:
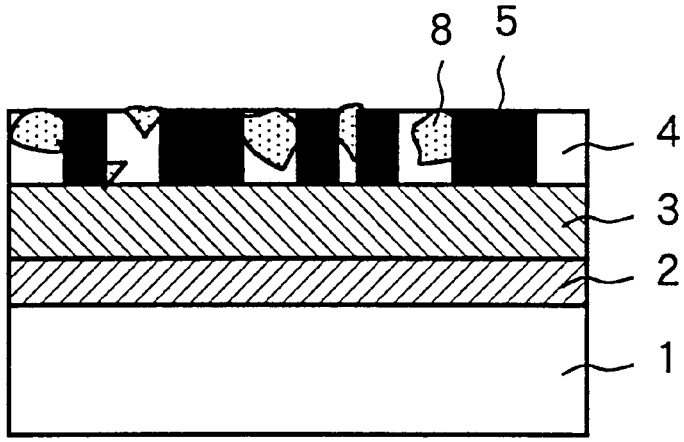
FIG. 2B is a sectional view of a metal sheet coated with a basecoat layer, a primer paint layer and a clear paint layer to which a colored design is given by transfer-printing in Example 3.
Figure 2C:
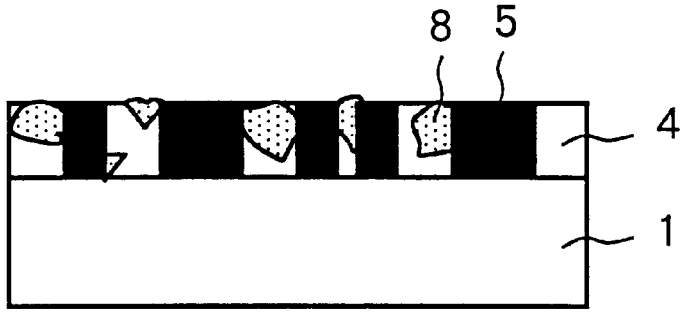
FIG. 2C is a sectional view of a metal sheet directly coated with a clear paint layer to which a colored design is given by transfer-printing in Example 3.

Powdery silica 8 of 0.5–8 μm in average particle size may be dispersed in a clear paint layer 4, as shown in FIGS. 2A–2C. The clear paint layer 4 is hardened to F or harder by dispersion of powdery silica 8 bigger than 0.5 μm to improve anti-scratching property and wear-resistance. Dispersion of the powdery silica 8 also effectively increases coloring concentration of a sublimation dye. However, dispersion of powdery silica bigger than 8 μm in the clear paint layer 4 causes occurrence of crackings in the clear paint layer 4 during bending the painted metal sheet as well as peeling of the clear paint layer 4 due to abrasion. Such bigger silica particles are also unfavorable for penetration of a sublimation dye with good coloring concentration.

The powdery silica 8 is dispersed in the clear paint layer 4 at a ratio of 1–10 wt. %. The anti-scratching property of the clear paint layer 4 is distinctly noted by dispersion of the powdery silica at a ratio of 1 wt. % or more. If the powder silica is quantitatively insufficient, a surface of the clear paint layer 4 is changed to a state having a glossiness value of 75 or more where scratches are conspicuously distinguished. However, excessive dispersion of the powdery silica at a ratio more than 10 wt. % decreases glossiness of the clear paint layer 4 to a value below 10 and weakens the transparency of the clear paint layer 4. Consequently, metallic luster of the substrate metal sheet 1 or a color tone of the basecoat paint layer 2 or the primer paint layer 3 cannot be used as a background for a printed design. Excessive dispersion of the powdery silica causes occurrence of crackings in the clear paint layer during bending of the painted metal sheet. The glossiness value of the clear paint layer 4 is preferably adjusted to 40–60 in case of using the metallic luster of the substrate metal sheet, or 10–30 in case of using the basecoat paint layer 2 or the primer paint layer 3 to make crackings inconspicuous.

An effect of the powdery silica 8 on coloring concentration of the sublimation dye is distinctly noted by dispersion of the powdery silica 8 at a ratio of 1 wt. % or more, but the coloring concentration is made constant with regard to silica content when the powdery silica is as follows dispersed at a ratio exceeding 10 wt. %. From many experiments, the inventors suppose the reason why coloring concentration is enhanced by dispersion of powdery silica as follows:

A sublimation dye is apt to excessively transfer, in the case where a printed design is given to a painted metal sheet by transfer-printing with a heat. When a transfer film textile-printed with a sublimation dye is laid on a painted metal sheet and heat-treated, some parts of the sublimated dye excessively move to an undercoat paint layer, and other parts return to the transfer film. The excessive movement of the dye is suppressed by the powdery silica 8 dispersed in the clear paint layer 4. Minute cavities are generated in and on the clear paint layer 4 due to dispersion of the powdery silica 8, so that the dye preferentially transfers along a thickness direction of the clear paint layer 4 rather than a surface direction. This preferential transfer of the dye increases coloring concentration, resulting in realization of an impressive printed design with high contrast.

A transfer film textile-printed with a sublimation dye is laid on a painted metal sheet and heated in contact with the topcoat or clear paint layer 4. A sublimated dye penetrates into the transparent or translucent paint layer 4 so as to form a part 5 colored with the dye which extends along a thickness direction of the paint layer 4. As a result, a colored design full of three-dimensional impression is realized with high contrast.

The transfer film may be prepared by gravure, offset or screen-printing. An electrophotography and electrographic recording, ink jet or heat-sensitive transfer-printing method using the computer graphics without necessity of the plate making step may be adopted in case of short-lot production, since an objective design is provided as occasion demands without stock burden. In addition, the printed design is not diminished, since the colored parts 5 are formed in the topcoat or clear paint layer 4. It is not necessary to cover the printed design with a transparent film after transfer-printing due to good stability of the printed design. By comparison a conventional laminated metal sheet is likely delaminated due to sole presence of colored parts between a topcoat or clear paint layer and the substrate metal sheet.

The sublimation dye is one which can transfer due to sublimation or vaporization in a heated state. The term "sublimation" in this specification involves vaporization from a liquid phase. The sublimation dye is selected from dispersion-type dyes such as quinophthalone derivatives, anthraquinones and azo pigment, for instance. Of course, various sublimation dyes conventionally used for thermally sublimating transfer or sublimating transfer textile-printing are also used for printing the topcoat or clear paint layer 4 without any restrictions on their kinds.

Yellow dyes useful as sublimation dyes for transfer-printing a painted metal sheet are Kayaset Yellow AG, Kayaset Yellow TDN (offered by NIPPON KAYAKU Co., Ltd.), RTY 52, Dianix Yellow 5R-E, Dianix Yellow F3G-E, Dianix Brilliant Yellow 5G-E (offer by MITSUBISHI Chemicals Co.,Ltd.), Blast Yellow 8040, DY108 (offered by ARIMOTO Chemicals Co., Ltd.), Sumikaron Yellow EFG, Sumikaron Yellow E-4GL (offered by SUMITOMO Chemicals Co., Ltd.), FORON Brilliant Yellow SGGLPI (offered by Sand Co.) and PS Yellow GG (MITSUI TOATSU Dyestuff Co., Ltd.)

Magenta dyes are Kayaset Red 026, Kayaset Red 130, Kayaset Red B (offered by NIPPON KAYAKU Co., Ltd.), Oil Red DR-99, Oil Red DK-99 (offered by ARIMOTO Chemicals Co., Ltd.), Diacelliton Pink B (offered by MITSUBISHI Chemicals Co., Ltd.), Sumikaron Red E-FBL (offered by SUMITOMO Chemicals Co., Ltd.), Latyl Red B (offered by Du Pont Co.), Sudan Red 7B (offered by BASF Co.), Resolin Red FB, Ceres Red 7B (offered by Bayer Co.).

Cyanic dyes are Kayalon Fast Blue FG, Kayalon Blue FR, Kayaset Blue 136, Katacet Blue 906 (offered by NIPPON KAYAKU Co., Ltd.), Oil Blue 63 (offered by ARIMOTO Chemicals Co., Ltd.), HSB9, RTB31 (offered by MITSUBISHI Chemicals Co., Ltd.), Disperse Blue #1 (offered by SUMITOMO Chemicals Co., Ltd.), MS Blue 50 (offered by MITSUI TOATSU Dyestuff Co., Ltd.), Ceres Blue GN (offered by Bayer Co.) and Duranol Brilliant Blue 2G (offered by ICI).

These sublimation dyes for various colors may be solely or combinatively used for realization of an objective colored design. A black tone is gained by properly mixing yellow, magenta and cyanic sublimation dyes. A dye having a sublimation temperature of 60° C. or higher may be used as a sublimation dye having a color tone other than yellow, magenta and cyanic tones. A sublimation dye having a higher sublimation temperature is preferable for bestowing a paint layer with good light-resistance and wear-resistance, since such a dye is relatively of bigger molecular weight.

The transparent or translucent paint layer 4 can be prevented from deterioration of adhesiveness or discoloration caused by permeation of a solar or ultraviolet beam, when an ultraviolet-absorbing agent is added to the paint layer 4. Such the ultraviolet-absorbing agent shall be good of heat-resistance, anti-sublimation and solubility. Preferably, an ultraviolet-absorbing agent having heat-resistance such that its weight loss is 10 wt. % or less when heated up to 300° C. at a speed of 5° C./minute in the open air. Such an ultraviolet-absorbing agent as benzotriazole or triazine satisfies the demands. Triazine solely or together with benzotriazole is preferably added to a resin paint for the topcoat or clear paint layer 4. It is also possible that a hindered amine photostabilizer may be additionally added to the resin paint at a ratio of 0–3.0 wt. %.

A benzotriazole ultraviolet-absorbing agent may be octyl-3-[3-t-butyl-5-(2H-benzotriazole-2-yl)-4-hydroxyphenyl] propinate (offered as TINUVIN 384 by Ciba-Geigy Co.), 2-[2-hydroxy-3,5-bis(α, α' dimethylbenzyl)phenyl]-2H-benzotriazole (offered as TINUVIN 900 by Ciba-Geigy Co.) a condensation product (offered as TINUVIN 1130 by Ciba-Geigy Co.) of methyl-3-[3-t-butyl-5-(2H-benzotriazole-2-yl)-4-hydroxyphenyl propinate with polyethylene glycol of approximately 300 molecular weight, 2-[2'-hydroxy-3'-(3",4",5",6"-tetrahydro phthalimide methyl)-5'-methylphenyl]-benzotriazol (offered as Viosorb 590 by KTODOH Pharmaceuticals Co., Ltd.).

A triazine ultraviolet-absorbing agent may be a mixture (offered as TINUVIN 400 by Ciba-Geigy Co.) of 2-[4-[(2-hydroxy-3-di-decyloxypropyl)-oxy]-2-hydroxyphenyl]-4,6-bis(2,4-dimethylphenyl)-1,3,5-triazine with 2-{4-[2-hydroxy-3-tridecyloxypropyl]-oxy}-2-hydroxyphenyl]-4,6-bis(2,4-dimethylphenyl-1,3,5-triazine.

These ultraviolet-absorbing agents may be solely or combinatively added to a topcoat resin paint at a ratio of 1–22 wt. % on the basis of a non-volatile component in the resin paint. If the ultraviolet-absorbing agent is added at a ratio more than 22 wt. %, the paint layer 4 is likely deteriorated in anti-fouling property, plasticity and external appearance. In addition, the paint layer 4 is toned with a color derived from the ultraviolet-absorbing agent.

A hindered amine photostabilizer may be optionally added to a resin paint at a ratio of 3 wt. % or less based on a non-volatile component in the resin paint in order to further improve light-resistance of the topcoat or clear paint layer 4. Such a hindered amine may be bis(2,2,6,6-tetramethyl-4-piperidyl)sebacate (offered as SANOL LS770 by SANKYO Co., Ltd.), bis(1,2,2,6,6-pentamethyl-4-piperidyl)sebacate (offered as SANOL L765 by SANKYO Co., Ltd.), 1-{2-[3-(3,5-di-t-butyl-4-hydroxyphenyl) propionyloxy]ethyl}-4-[3-(3,5-di-t-butyl-4-hydroxyphenyl) propionyloxy]-2,2,6,6-tetramethylpiperidine (offered as SANOL LS2626 by SANKYO Co., Ltd.), 4-benzoyloxy-2,2,6,6-tetramethylpiperidine (offered as SANOL LS744 by the SANKYO Co., Ltd.), 8-acetyl-3-dodecyl-7,7,9,9-tetramethyl-1,3,8-triaza spiro[4,5]decane-2,4-dione (offered as SANOL LS440 SANKYO Co., Ltd.), 2-[3,5-di-t-hydroxybenzyl-2-n-butyl malonic acid bis(1,2,2,6,6-pentamethyl-4-piperidyl)] (offered as TINUVIN144 by Ciba-Geigy Co.), succinic acid bis(2,2,6,6-tetramethyl-4-piperidyl)ester (offered as TINUVIN780FF by Ciba-Geigy Co.), a polycondensation product (offered as TINUVIN 622 LD by Ciba-Geigy Co.) of succinic acid dimethyl with 1-(2-hydroxyethyl)-4-hydroxy-2,2,6,6-tetramethylpiperidine, poly{[6-(1,1,3,3-tetramethylbutyl) amino-1,3,5-triazine-2,4-diyl][(2,2,6,6-tetramethyl-4-piperidyl)imino]hexamethylene[(2,2,6,6-tetramethyl-4-piperidyl)imino]} (offered as CHIMASSORB 944LD by Ciba-Geigy Co.), a polycondensation product (offered as CHIMASSORB 119 FL by Ciba-Geigy Co.) of N,N'-bis(3-aminopropyl)ethylenediamine with 2,4-bis[N-butyl-N-(1,2,2,6,6-pentamethyl-4-piperidyl)amino]-6-chloro-1,3,5-triazine, bis(1,2,2,6,6-pentamethyl-4-piperidyl)sebacate (offered as TINUVIN 292 by Ciba-Geigy Co.), bis(1-octaoxy-2,2,6,6-tetramethyl-4-piperidyl)sebacate (offered as TINUVIN 123 by Ciba-Geigy Co.), HA-70G (offered by SANKYO Co., Ltd.), ADECA STAB LA-52, ADECA STAB LA-57, ADECA STAB LA-62, ADECA STAB LA-63, ADECA STAB LA-67, ADECA STAB LA-68, ADECA STAB LA-82 or ADECA STAB LA-87 (offered by ASAHI DENKA KOGYO Co.,Ltd.).

These photostabilizers may be solely or combinatively added to a resin paint at a ratio of 3.0 wt. % or less (preferably 0.5–1.5 wt. %). An effect of the photostabilizer on light-resistance of the paint layer 4 is saturated up to a ratio of 3.0 wt. %. Excessive addition of the photostabilizers causes inferior external appearance of the paint layer 4.

Figure 3A:
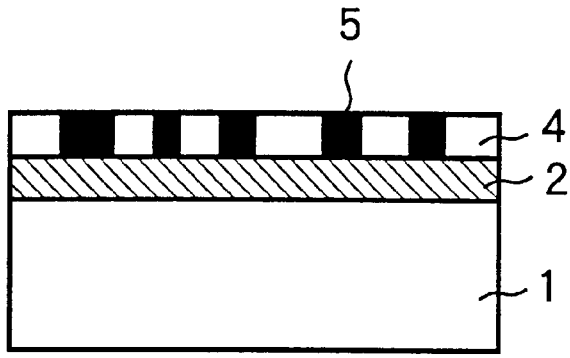
FIG. 3A is a sectional view of a metal sheet coated with a basecoat paint layer and a transparent or translucent topcoat paint layer to which a colored design is given by transfer-printing in Example 5.
Figure 3B:
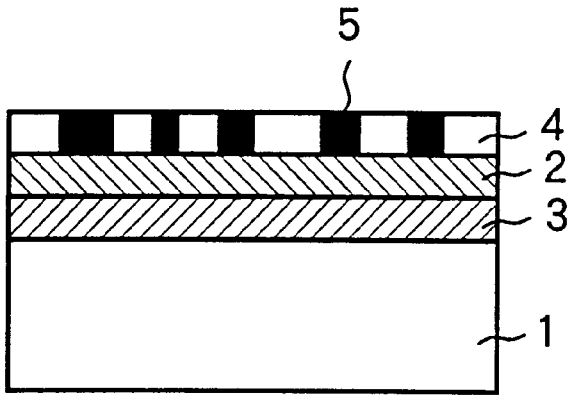
FIG. 3B is a sectional view of a metal sheet coated with a basecoat paint layer, a primer paint layer and a transparent or translucent topcoat paint layer to which a colored design is given by transfer-printing in Example 5.
Figure 3C:
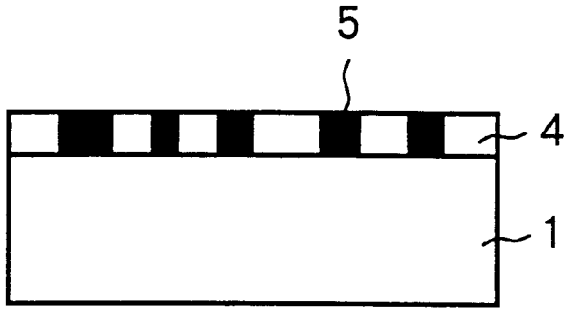
FIG. 3C is a sectional view of a metal sheet directly coated with a transparent or translucent topcoat paint layer to which a colored design is given by transfer-printing in Example 5.

FIGS. 3A–3C depict a painted metal sheet comprising a substrate metal sheet 1 coated with a transparent or translucent topcoat or clear paint layer 4. A basecoat paint layer 2 and a primer paint layer 3 may be optionally formed between the substrate metal sheet 1 and the topcoat or clear paint layer 4. Colored parts 5 are formed in the topcoat or clear paint layer 4.

EXAMPLE 1

Production of a Painted Steel Sheet Which Has a Topcoat Paint Layer 4 Printed with a Sublimation Dye Directly Formed on a Substrate Steel Sheet 1 (Samples Nos. 1–11 and Comparative Samples Nos. 1–4, 7–12)

A stainless steel sheet (SUS 304HL) of 0.5 mm in thickness was degreased, cleaned and then chromated. Thereafter, a translucent topcoat paint was applied to the sheet and baked at 230° C. for 1 minute to form a translucent topcoat resin layer 4 of 16 μm in dry thickness directly on a substrate steel sheet 1, as shown in FIG. 1C. The used Topcoat Paint was a polyester resin paint containing glass flakes (of 4–12 μm in thickness and 45–90 μm in length) at a ratio of 3–30 wt. %, calcium silicate (of 3.5–8 μm in average primary particle size) at a ratio of 0.3–12 wt. % and a triazine ultraviolet-absorbing agent (TINUVIN 400 by Ciba-Geigy Co.) at a ratio of 6 wt. %, each based on a non-volatile component of the paint.

A transfer film was prepared by outputting an objective design with a sublimation dye toner (offered as a sublimable textile-printing toner by Nippon Steel Chemical Co., Ltd.), onto an electrographic recording sheet by an image printer (Juana by Exis Co.,Ltd.) of an electrostatic plotter system.

The transfer film was laid on the topcoat paint layer 4 formed on the substrate metal sheet 1 and pressed onto the topcoat paint layer 4 with a pressure of 50000 Pa at 160° C. for 240 seconds. Thereafter, the transfer film was separated from the painted steel sheet.

Production of a Painted Steel Sheet which has a Basecoat Paint layer 2 Between a Substrate Steel Sheet 1 and a Topcoat Paint Layer 4 Printed with a Sublimation Dye (Samples Nos. 12–15 and Comparative Samples Nos. 5–6)

A galvanized steel sheet of 0.5 mm in thickness was degreased, cleaned and then chromated. Thereafter, a white polyester resin paint was applied to the steel sheet and baked at 220° C. for 1 minute to form a white basecoat paint layer 2 of 18 μm in dry thickness. The same translucent polyester resin paint as above-mentioned was applied to the basecoat paint layer 2 and baked at 230° C. for 1 minute to form a translucent topcoat paint layer 4 of 16 μm in dry thickness. A color design was given to the topcoat paint layer 4 using a transfer film in the same way.

TABLE 1

FILLERS IN TOPCOAT PAINT LAYERS FORMED ON STEEL SHEETS (the present invention)

| | | glass flakes | | | calcium silicate | |
|---|---|---|---|---|---|---|
| Sample No. | kind of steel sheet | content wt. % | thickness μm | average length μm | content wt. % | Average particle size μm |
| 1 | stainless | 20 | 4 | 45 | 0.5 | 3.5 |
| 2 | steel sheet | 20 | 4 | 45 | 2.5 | 3.5 |
| 3 | (SUS 304) | 20 | 4 | 45 | 5.0 | 3.5 |
| 4 | hair-line | 20 | 4 | 45 | 10.0 | 3.5 |
| 5 | finished | 5 | 4 | 45 | 2.5 | 3.5 |
| 6 | | 10 | 4 | 45 | 2.5 | 3.5 |
| 7 | | 15 | 4 | 45 | 2.5 | 3.5 |
| 8 | | 25 | 4 | 45 | 2.5 | 3.5 |
| 9 | | 20 | 8 | 45 | 5.0 | 3.5 |
| 10 | | 20 | 8 | 45 | 5.0 | 8.0 |
| 11 | | 20 | 4 | 70 | 5.0 | 3.5 |
| 12 | galvanized | 5 | 4 | 45 | 0.5 | 3.5 |
| 13 | steel sheet | 15 | 4 | 45 | 2.5 | 3.5 |
| 14 | | 25 | 4 | 45 | 10.0 | 3.5 |
| 15 | | 20 | 4 | 70 | 5.0 | 8.0 |

TABLE 2

FILLERS DISPERSED IN TOPCOAT PAINT LAYERS FORMED ON STEEL SHEETS

| | | glass flakes | | | | (Comparative Samples) calcium silicate | |
|---|---|---|---|---|---|---|---|
| Sample No. | kind of steel sheet | content wt. % | average particle size μm | thickness μm | average length μm | content wt. % | average particle size μm |
| 1 | stainless steel sheet | 30 | — | 4 | 45 | 5.0 | 3.5 |
| 2 | (SUS 304) | 3 | — | 4 | 45 | 5.0 | 3.5 |
| 3 | hair-line finished | 15 | — | 12 | 45 | 5.0 | 3.5 |
| 4 | | 15 | — | 4 | 90 | 5.0 | 3.5 |
| 5 | galvanized steel sheet | 15 | — | 12 | 45 | 5.0 | 3.5 |
| 6 | | 15 | — | 4 | 90 | 5.0 | 3.5 |
| 7 | stainless steel sheet | 15 | — | 4 | 8 | 5.0 | 3.5 |
| 8 | (SUS 304) | 20 | — | 4 | 45 | 0.3 | 3.5 |
| 9 | hair-line finished | 20 | — | 4 | 45 | 12.0 | 3.5 |
| 10* | | 20 | 10 | — | — | — | — |
| 11* | | 20 | 6 | — | — | — | — |
| 12* | | 20 | 4.5 | — | — | — | — |

*Silica (Comparative Samples 10 and 11) and feldspar (Comparative Sample 12) were dispersed in resin paints, instead of glass flakes.

Fillers dispersed in a topcoat paint layer 4 formed on each steel sheet according to the present invention and comparative tests are shown in Tables 1 and 2, respectively.

Each painted steel sheet printed with the colored design was tested to research adhesiveness and hardness of the paint layer, workability, slippage-proof property wear-resistance, smoothness and transparency.

Adhesiveness of the paint layer was examined by a checkered Erichsen test (engraving the paint layer to a checkered pattern and then drawing it by a length of 6 mm, as regulated in JIS G3320). An adhesive tape was stuck onto the drawn part of a test piece and then peeled off. Peeled states of paint layers were classified to 5 levels to evaluate adhesiveness.

Workability of the painted steel sheet was examined by a bending test piece at a room temperature of 20° C., wherein a test piece was bent with 180 degrees in the state that one or more sheets having the same thickness as the test piece were sandwiched. Workability was judged by the number t of the sandwiched sheets until the paint layer was cracked at the bent part, and evaluated as follows. A painted steel sheet, which was bent at 0–2t without crackings, was excellent (◎) in workability. A painted steel sheet, which was cracked in the paint layer at 3–4t, was good (○) in workability. A painted steel sheet, which was cracked in the paint layer at 5t, was poor (Δ) in workability. A painted steel sheet, which was cracked in the paint layer at 6t, was bad (x) in workability. Such painted steel sheets evaluated as ◎ or ○ can be offered as precoated steel sheets to a market.

Hardness of the paint layer was examined by a scratching test using a pencil MITSHUBISHI UNI (offered by MITSHUBISHI Pencil Co., Ltd.), as regulated in JIS K5499-6-8.4. Hardness was judged by a highest pencil hardness with which the paint layer was not scratched.

A slippage test was performed using a dynamic slip tester to measure static and dynamic friction coefficients. A test piece was stuck to a bottom of a sled metal, and a neoprene rubber of 5 mm in thickness and 60 in Shore A hardness was stuck onto a slide plate. A weight was mounted on the sled metal to adjust a total weight to 800 g. The sled metal was shifted in contact with the slide plate under this condition. A static friction coefficient was calculated from a maximum static friction force at the moment when the sled metal began to move, while a dynamic friction coefficient was calculated from a dynamic friction force at 20 seconds after sliding of the sled metal began.

$$\text{A static or dynamic friction coefficient} = F/P,$$

herein F is a maximum static or dynamic friction force,

P is a total weight of a sled metal and a balance weight.

Wear-resistance of the painted steel sheet was examined by a Taber abrader. A disk-shaped test piece of 120 mm in diameter, which had an opening of 6 mm in diameter formed at its center, was fixed to the abrader. After the test piece was rotated 200 times under this condition, it was weighed to detect a weight loss caused by abrasion. A Taber value(wear index) was calculated from the detected weight loss according to the formula of:

$$\text{A Taber value} = \text{a weight loss (mg)} \times 1000/\text{a rotation number (200)}$$

Smoothness of a paint layer 4 was measured by a contact-type roughness meter, and evaluated by an average surface roughness value Ra along a center line Transparency of a paint layer 4 was judged by naked eye's observation and evaluated as follows: The mark ○ means good transparency sufficient to use a color tone of a basecoat paint layer 2 as a background for a printed design. The mark Δ means transparency of a paint layer 4 which was used as a background although a little dim. The mark x means poor transparency of a paint layer 4 which cannot be used as a background for a printed design.

Test results are shown in Table 3 (the present invention) and Table 4 (Comparative Tests), respectively.

It is apparently noted from comparison of the results in Table 3 with the results in Table 4 that any painted steel sheet printed according to the present invention was excellent in all of adhesiveness, hardness, workability, slippage-proof property, smoothness and transparency. The slippage-proof property became better with the increase of calcium silicate, although wear-resistance and transparency were degraded a little. That is, it is understood that a ratio of calcium silicate shall be determined in response to which property is determined be important for a coated steel product among design, wear-resistance and slippage-proof. It is also noted from Table 3 that the paint layer was harded with the increase of glass flakes.

On the other hand, Comparative Samples were inferior of at least one of adhesiveness, hardness, workability, slippage-proof property, smoothness or transparency, as shown in Table 4. In actuality, Comparative Sample No. 1 had poor transparency, Comparative Sample No. 2 lacked hardness, Comparative Samples Nos. 3–6 were inferior in adhesiveness and workability due to inadequate particle size of glass flakes, Comparative Sample No. 7 had insufficient of slippage-proof property due to dispersion of relatively short glass flakes, Comparative Sample No. 8 had insufficient of slippage-proof property due to shortage of calcium silicate, and Comparative Sample No. 9 had poor of transparency due to excessive dispersion of calcium silicate.

TABLE 3

PROPERTIES OF COATED STEEL SHEET PRINTED WITH SUBLIMATION DYE

| | | | | slippage-proof | | | (the present invention) surface | |
|---|---|---|---|---|---|---|---|---|
| Sample No. | adhesiveness of paint layer | pencil hardness | Workability | dynamic friction coefficient | static friction coefficient | wear-resistance a Taber value | roughness Ra (μm) | transparency |
| 1 | 5 | 3H | ◎ | 0.32 | 0.42 | 15.5 | 2.6 | ○ |
| 2 | 5 | 3H | ◎ | 0.47 | 0.57 | 14.6 | 2.5 | ○ |
| 3 | 5 | 3H | ◎ | 0.51 | 0.64 | 18.7 | 2.7 | Δ |
| 4 | 5 | 3H | ◎ | 0.62 | 0.78 | 25.1 | 2.4 | Δ |
| 5 | 5 | 2H | ◎ | 0.44 | 0.51 | 11.5 | 1.2 | ○ |
| 6 | 5 | 2H | ◎ | 0.48 | 0.58 | 12.1 | 2.0 | ○ |
| 7 | 5 | 3H | ◎ | 0.42 | 0.65 | 15.0 | 2.8 | ○ |
| 8 | 5 | 3H | ◎ | 0.40 | 0.57 | 19.9 | 2.4 | ○ |
| 9 | 4 | 3H | ○ | 0.41 | 0.59 | 31.3 | 3.1 | Δ |
| 10 | 4 | 2H | ○ | 0.48 | 0.48 | 39.2 | 3.4 | Δ |
| 11 | 4 | 2H | ○ | 0.47 | 0.46 | 22.6 | 3.2 | Δ |

TABLE 3-continued

PROPERTIES OF COATED STEEL SHEET PRINTED WITH SUBLIMATION DYE

| Sample No. | adhesiveness of paint layer | pencil hardness | Workability | slippage-proof dynamic friction coefficient | slippage-proof static friction coefficient | wear-resistance a Taber value | (the present invention) surface roughness Ra (μm) | transparency |
|---|---|---|---|---|---|---|---|---|
| 12 | 5 | 2H | ◎ | 0.37 | 0.50 | 18.9 | 1.3 | ○ |
| 13 | 5 | 2H | ◎ | 0.46 | 0.67 | 11.8 | 2.5 | ○ |
| 14 | 5 | 2H | ◎ | 0.67 | 0.59 | 32.8 | 2.2 | Δ |
| 15 | 4 | 2H | ○ | 0.45 | 0.51 | 34.5 | 3.1 | Δ |

TABLE 4

PROPERTIES OF COATED STEEL SHEET PRINTED WITH SUBLIMATION DYE

| Sample No. | kind of steel sheet | adhesiveness of paint layer | pencil hardness | workability | slippage-proof dynamic fricition coefficient | slippage-proof static friction coefficient | wear-resistance a Taber value | (Comparative Samples) surface roughness Ra (μm) | transparency |
|---|---|---|---|---|---|---|---|---|---|
| 1 | stainless steel sheet | 4 | 3H | ◎ | 0.40 | 0.54 | 16.3 | 2.1 | x |
| 2 | (SUS 304) | 5 | F | ◎ | 0.29 | 0.37 | 17.4 | 1.2 | ○ |
| 3 | hair-line finished | 2 | 2H | x | 0.45 | 0.59 | 43.8 | 3.1 | ○ |
| 4 | | 2 | H | x | 0.50 | 0.61 | 39.5 | 3.6 | ○ |
| 5 | galvanized steel sheet | 2 | 2H | x | 0.54 | 0.63 | 27.9 | 2.9 | ○ |
| 6 | | 2 | H | x | 0.59 | 0.67 | 28.4 | 3.0 | ○ |
| 7 | stainless steel sheet | 5 | 2H | ◎ | 0.29 | 0.37 | 15.6 | 0.8 | ○ |
| 8 | (SUS 304) | 5 | 3H | ◎ | 0.21 | 0.29 | 28.9 | 2.7 | ○ |
| 9 | hair-line finished | 5 | 2H | ◎ | 0.48 | 0.63 | 36.8 | 2.9 | x |
| 10 | | 5 | 2H | ◎ | 0.28 | 0.29 | 44.6 | 1.8 | ○ |
| 11 | | 5 | 2H | ◎ | 0.26 | 0.28 | 45.9 | 0.7 | ○ |
| 12 | | 5 | 2H | ◎ | 0.24 | 0.27 | 49.8 | 0.6 | Δ |

EXAMPLE 2

Production of a Coated Steel Sheet Having a Basecoat Paint Layer 2 on Which a Topcoat Paint Layer 4 was Formed and Printed with a Sublimation Dye (Samples Nos. 16–27, Comparative Samples Nos. 13–17)

A galvanized steel sheet of 0.5 mm in thickness was degreased, cleaned and then chromated. Thereafter, a white polyester resin paint was applied to the sheet and baked at 220° C. for 1 minute to form a white base coat paint layer 2 of 18 μm in dry thickness. A topcoat polyester resin paint was further applied to the basecoat paint layer 2 and baked at 230° C. for 1 minute to form a translucent paint layer 4 of 16 μm in dry thickness.

The topcoat resin paint for Samples Nos. 16–17 and Comparative Sample No. 13 was prepared by adding glass flakes (of 4 μm in thickness and 45 μm in length) at a ratio of 20 wt. %, calcium silicate (of 3.5 μm in average primary particle size) at a ratio of 5 wt. %, a triazine ultraviolet-absorbing agent (TINUVIN 400 by Ciba-Geigy Co., Ltd.) and/or a benzotriazole ultraviolet-absorbing agent (TINUVIN 384 by Ciba-Geigy Co., Ltd.) at a ratio of 0–9 wt. % and a hindered amine photostabilizer (TINUVIN 123 by Ciba-Geigy Co., Ltd.) at a ratio of 1.5 wt. %, each based on a non-volatile component of a polyester resin. A topcoat resin paint for Comparative Samples Nos. 14–17 was prepared by addition of a benzophenone ultraviolet-absorbing agent (Viosorb 130 by KYODOH Pharmaceuticals Co., Ltd.) instead of the triazine and/or benzotriazole ultraviolet-absorbing agent at a ratio of 1–9 wt. % based on a non-volatile component of a polyester resin.

Before preparation of the topcoat paint, each ultraviolet-absorbing agent was tested by thermogravimetric analysis, wherein the ultraviolet-absorbing agent was heated up to 300° C. at 5° C./minute and its weight loss was measured. A weight loss of each ultraviolet-absorbing agent was as follows: 3.5 wt. % for triazine, 5 wt. % for benzotriazole and 33 wt. % for benzophenone. The results proved that the triazine and benzotriazole ultraviolet-absorbing agents were superior of wear- and heat-resistance.

A transfer film was prepared by outputting an objective design with a sublimation dye toner (a sublimatable textile-printing toner by Nippon Steel Chemical Co., Ltd.) made from a cyanic dye (C. I. Disperse Blue 26 by MITSUBISHI Chemicals Co., Ltd.) onto an electrographic recording sheet by an image printer (Juana by Exis Co.,Ltd.) of an electrostatic plotter system, to realize a wholly cyanic pattern.

The transfer film was laid on the topcoat paint layer 4 of the coated steel sheet and pressed onto the topcoat paint layer 4 with a pressure of 50000 Pa at 160° C. for 240 seconds. Thereafter, the transfer film was separated from the painted steel sheet. Since the cyanic dye produces the weakest of light-resistance among various cyanic, magenta and yellow dyes which sublimate under the same conditions, effects of the ultraviolet-absorbing agent and the photostabilizer were accurately evaluated by use of the cyanic dye.

Evaluation of Coated Steel Sheets Printed with Sublimation Dyes

A test piece cut off each painted steel sheet printed with a sublimation dye was subjected to a light-resistance test as follows: The test piece was held 240 hours at 63° C. in a state irradiated 60 minutes with a ultraviolet beam from a carbon arc weather meter while spraying fresh water 12 minutes during holding. A cyanic color tone of the test piece was measured after the holding, and compared with a color tone of an unexamined test piece to calculate a color difference ΔE. Such a color difference ΔE is preferably kept less than 7 for using a painted steel sheet as an outdoor member for 3 years or longer. A painted steel sheet, which exhibits a color difference ΔE above 10, is not practically used as an outdoor member.

Adhesiveness of the topcoat paint layer 4 and workability of the coated steel sheet were also researched in the same way as Example 1, after the light-resistance test.

Test results are separately shown in Table 5 (the present invention) and Table 6 (Comparative Samples).

Samples according to the present invention were excellent in all of light-resistance, adhesiveness of paint layers and workability, as shown in Table 5. It is apparently noted that addition of a triazine ultraviolet-absorbing agent together with a benzotriazole ultraviolet-absorbing agent effectively improved light-resistance of the colored design, compared with sole addition of a triazine or benzotriazole ultraviolet-absorbing agent.

On the other hand, Comparative Sample No. 13 was inferior in all of light-resistance, adhesiveness of a paint layer and workability. Comparative Samples Nos. 14–17 having paint layers, to which a benzophenone ultraviolet-absorbing agent was added instead of a triazine or benzotriazole ultraviolet-absorbing agent, were insufficient in light-resistance.

TABLE 5

PROPERTIES OF TOPCOAT PAINT LAYERS (the present invention)

| | ultraviolet-absorbing agent | | results of light-resistance test (240 hours, at 63° C.) | | |
|---|---|---|---|---|---|
| Sample No. | kind and ratio | contents wt. % | color difference ΔE | Adhesiveness of paint layers | work-ability |
| 16 | Triazine | 1.0 | 6.1 | 5 | ◎ |
| 17 | | 3.0 | 4.0 | 5 | ◎ |
| 18 | | 6.0 | 2.9 | 5 | ◎ |
| 19 | | 9.0 | 2.2 | 5 | ◎ |
| 20 | Benzotriazole | 1.0 | 6.8 | 5 | ◎ |
| 21 | | 3.0 | 4.7 | 5 | ◎ |
| 22 | | 6.0 | 3.5 | 5 | ◎ |
| 23 | | 9.0 | 2.9 | 5 | ◎ |
| 24 | triazine and | 1.0 | 5.9 | 5 | ◎ |
| 25 | benzotriazole | 3.0 | 3.7 | 5 | ◎ |
| 26 | at a ratio of 1:1 | 6.0 | 2.5 | 5 | ◎ |
| 27 | | 9.0 | 2.0 | 5 | ◎ |

TABLE 6

PROPERTIES OF TOPCOAT PAINT LAYERS (Comparative Samples)

| | ultraviolet-absorbing agent | | results of light-resistance test (240 hours, at 63° C.) | | |
|---|---|---|---|---|---|
| Sample No. | kind | contents wt. % | color difference ΔE | adhesiveness of paint layers | work-ability |
| 13 | no addition | 0 | 21.2 | 3 | x |
| 14 | benzophenone | 1.0 | 15.4 | 4 | Δ |
| 15 | | 3.0 | 13.4 | 5 | ○ |
| 16 | | 6.0 | 11.3 | 5 | ○ |
| 17 | | 9.0 | 10.1 | 5 | ◎ |

EXAMPLE 3

Production of a Painted Steel Sheet which has a Topcoat Paint Layer 4 Printed with a Sublimation Dye Directly Formed on a Substrate Steel Sheet 1 (Samples Nos. 1–6 and Comparative Samples Nos. 1–4, 7–12)

A stainless steel sheet (SUS 304HL) of 0.5 mm in thickness was degreased, cleaned and then chromated. Thereafter, a translucent topcoat paint was applied to the sheet and baked at 230° C. for 1 minute to form a translucent topcoat resin layer 4 of 12 μm in dry thickness directly on a substrate steel sheet 1, as shown in FIG. 2C. The used topcoat paint was a polyester resin paint containing powdery silica 8 (of 0.3–1.2 μm in average particle size) at a ratio of 0.5–15 wt. %, and a triazine ultraviolet-absorbing agent (TINUVIN 400 by Ciba-Geigy Co.) at a ratio of 3 wt. %, each based on a non-volatile component of the paint.

Production of a Painted Steel Sheet Having a Basecoat Paint Layer 2 on which a Clear Paint Layer 4 Printed with a Sublimation Dye was Formed (Samples Nos. 7–12 and Comparative Samples Nos. 5–8)

A galvanized steel sheet of 0.5 mm in thickness was degreased, cleaned and then chromated. Thereafter, a white polyester resin paint was applied to the steel sheet and baked at 220° C. for 1 minute to form a white basecoat paint layer 2 of 15 μm in dry thickness. The same translucent polyester resin paint as above-mentioned was applied to the basecoat paint layer 2 and baked at 230° C. for 1 minute to form a translucent topcoat paint layer 4 of 12 μm in dry thickness. A color design was given to the topcoat paint layer 4 by transfer-printing using a transfer film in the same way.

Dispersion of powdery silica in the clear paint layer 4 of each coated steel sheet is shown in Table 7.

TABLE 7

POWDERY SILICA ADDED AS FILLERS DISPERSED IN CLEAR PAINT LAYERS OF COATED STEEL SHEETS

| | | | powdery silica | |
|---|---|---|---|---|
| NOTE | Sample No. | kind of substrate steel sheet | contents wt. % | average particles size μm |
| PRESENT INVENTION | 1 | stainless steel sheet | 1.0 | 2.5 |
| | 2 | (SUS 304), | 2.5 | 2.5 |
| | 3 | hair-line finished | 5.0 | 2.5 |
| | 4 | | 10.0 | 2.5 |
| | 5 | | 5.0 | 0.5 |
| | 6 | | 5.0 | 8.0 |
| | 7 | galvanized | 1.0 | 2.5 |
| | 8 | steel sheet | 2.5 | 2.5 |
| | 9 | | 5.0 | 2.5 |
| | 10 | | 10.0 | 2.5 |
| | 11 | | 5.0 | 0.5 |
| | 12 | | 5.0 | 8.0 |
| COMPARATIVE TESTS | 1 | stainless steel sheet | 0.5 | 2.5 |
| | 2 | (SUS 304), | 15.0 | 2.5 |
| | 3 | hair-line finished | 5.0 | 0.3 |
| | 4 | | 5.0 | 12.0 |
| | 5 | galvanized | 0.5 | 2.5 |
| | 6 | steel sheet | 15.0 | 2.5 |
| | 7 | | 5.0 | 0.3 |
| | 8 | | 5.0 | 12.0 |

Transfer-printing with a Sublimation Dye

A transfer film prepared in the same way as Example 1 was pressed onto the topcoat paint layer 4 with a pressure of 5000 Pa at 160° C. for 240 seconds. Thereafter, the transfer film was separated from the painted steel sheet.

Evaluation of Coated Steel Sheets Printed with Sublimation Dyes

A test piece cut off each coated steel sheet was offered to the same tests as Example 1 to research adhesiveness and hardness of a topcoat paint layer, workability and transparency. In this Example 3, reflection intensity and glossiness of the clear paint layer were also testified as follows.

Reflection density from the clear paint layer 4 printed with a cyanic dye was measured by a reflection intensimeter (Color Checker SERIES1200 by Macbeth Co.).

Glossiness was judged from reflectivity measured by emitting a light beam to a test piece with incidence and reflection angles of 60 degrees, and detecting reflected rays with a specular reflectivity detector.

Brightness (a value L) at a cyanic colored part was measured in order to research an effect of powdery silica on glossiness, and transparency of the paint layer 4 was evaluated by a lightness difference ΔL calculated according to the formula of:

$$\Delta L = L_1 - L_0,$$

wherein, $L_1$ is a value L of a coated steel sheet, and $L_0$ is a value L of a coated steel sheet having a paint layer 4 which did not contain powdery silica Test results are shown in Table 8. It is noted that any Sample according to the present invention was excellent in all of adhesiveness, pencil hardness, workability, wear-resistance, reflection density, glossiness and transparency. As increase of powdery silica dispersed in the paint layer, the paint layer was more hardened, but its wear-resistance and transparency were degraded a little bit.

On the other hand, Comparative Samples were inferior of at least one of adhesiveness, pencil hardness, workability, wear-resistance, reflection density, glossiness and transparency. That is, Comparative Samples Nos. 1 and 5 had excessively glossy surfaces, on which scratches were apparently distinguished, due to insufficient dispersion of powdery silica. Comparative Samples Nos. 2 and 6 were poor of transparency and workability due to excessive dispersion of powdery silica. Comparative Samples Nos. 3 and 7 lacked hardness for practical use due to dispersion of too fine powdery silica. Comparative Samples Nos. 4 and 8 had opaque paint layers inferior of wear-resistance due to dispersion of excessively large particles of powdery silica.

A galvanized steel sheet of 0.5 mm in thickness was degreased, cleaned and then chromated. Thereafter, a white polyester resin paint was applied to the sheet and baked at 220° C. for 1 minute to form a white base coat paint layer 2 of 15 μm in dry thickness. A topcoat polyester resin paint was further applied to the basecoat paint layer 2 and baked at 230° C. for 1 minute to form a translucent paint layer 4 of 12 μm in dry thickness.

The topcoat resin paint for Samples Nos. 13–21 and Comparative Sample No. 9 was prepared by adding powdery silica (of 2.5 μm in average particle size) at a ratio of 5.0 wt. %, a triazine ultraviolet-absorbing agent (TINUVIN 400 by Ciba-Geigy Co., Ltd.) and/or a benzotriazole ultraviolet-absorbing agent (TINUVIN 384 by Ciba-Geigy Co., Ltd.) at a ratio of 0–6 wt. % and a hindered amine photostabilizer (TINUVIN 123 by Ciba-Geigy Co., Ltd.) at a ratio of 1.5 wt. %, each based on a non-volatile component of a translucent polyester resin. A topcoat resin paint for Comparative Samples Nos. 10–12 was prepared by addition of a benzophenone ultraviolet-absorbing agent (Viosorb 130 by KYODOH Pharmaceuticals Co., Ltd.) instead of the triazine and/or benzotriazole ultraviolet-absorbing agent at a ratio of 1–6 wt. % based on a non-volatile component of the same polyester resin.

Transfer-Printing

The same transfer film as in Example 3 was laid on a clear paint layer 4 of each coated steel sheet and pressed onto the clear paint layer 4 for 240 seconds at 160° C. with a pressure of 50000 Pa at 160° C. for 240 seconds. Thereafter, the transfer film was separated from the painted steel sheet.

A test piece was cut off each Sample or Comparative Sample and offered to the same light-resistance test as in Example 2. Adhesiveness of each clear paint layer 4 as well as workability of each coated steel sheet were tested in the same way as in Example 1.

Test results are separately shown in Table 9 (the present invention) and Table 10 (Comparative Samples).

TABLE 8

PROPERTIES OF COATED STEEL SHEETS

| NOTE | Sample No. | adhesiveness of paint layer | pencil hardness | workability | reflection density | glossiness | transparency ΔL | wear-resistance a Taber value |
|---|---|---|---|---|---|---|---|---|
| PRESENT INVENTION | 1 | 5 | 2H | ◎ | 2.1 | 74.3 | 3.4 | 18.7 |
| | 2 | 5 | 3H | ◎ | 2.2 | 60.2 | 4.1 | 19.6 |
| | 3 | 5 | 3H | ◎ | 2.5 | 35.7 | 5.2 | 21.3 |
| | 4 | 5 | 3H | ○ | 2.8 | 15.8 | 7.9 | 25.5 |
| | 5 | 5 | 2H | ◎ | 2.5 | 38.3 | 6.2 | 18.4 |
| | 6 | 4 | 3H | ○ | 2.4 | 32.8 | 6.4 | 30.7 |
| | 7 | 5 | 2H | ◎ | 2.3 | 70.4 | 4.0 | 17.5 |
| | 8 | 5 | 3H | ◎ | 2.5 | 55.0 | 5.1 | 19.0 |
| | 9 | 5 | 3H | ◎ | 2.9 | 31.9 | 6.2 | 21.7 |
| | 10 | 5 | 3H | ○ | 3.1 | 11.2 | 9.2 | 26.1 |
| | 11 | 5 | 2H | ◎ | 2.9 | 33.4 | 6.8 | 17.6 |
| | 12 | 4 | 3H | ○ | 3.0 | 29.1 | 7.0 | 31.3 |
| COMPARATIVE | 1 | 5 | F | ◎ | 1.5 | 82.5 | 1.6 | 25.3 |
| | 2 | 4 | 3H | x | 2.8 | 8.3 | 13.8 | 33.6 |
| | 3 | 5 | F | ◎ | 1.8 | 40.1 | 6.8 | 23.5 |
| | 4 | 3 | 3H | x | 1.8 | 30.6 | 8.2 | 42.1 |
| | 5 | 5 | F | ◎ | 1.7 | 77.5 | 3.9 | 24.6 |
| | 6 | 4 | 3H | x | 3.1 | 6.0 | 15.2 | 34.1 |
| | 7 | 5 | F | ◎ | 2.5 | 35.7 | 7.5 | 24.2 |
| | 8 | 3 | 3H | x | 2.6 | 28.3 | 9.2 | 43.7 |

EXAMPLE 4

Production of a Coated Steel Sheet Having a Basecoat Paint Layer 2 on which a Clear Paint Layer 4 was Formed and Printed with a Sublimation Dye (Samples Nos. 13–21, Comparative Samples Nos. 9–12)

Samples according to the present invention were excellent in all of light-resistance, adhesiveness of paint layers and workability, as shown in Table 9. It is apparently noted that addition of a triazine ultraviolet-absorbing agent together with a benzotriazole ultraviolet-absorbing agent effectively improved light-resistance of the colored design, compared with sole addition of a triazine or benzotriazole ultraviolet-absorbing agent.

On the other hand, Comparative Sample No. 9 was inferior in all of light-resistance, adhesiveness and workability, and Comparative Samples Nos. 10–12 were insufficient of light-resistance.

TABLE 10

PROPERTIES OF TOPCOAT PAINT LAYERS

| | ultraviolet-absorbing agent | | after light-resistance test (500 hours at 53° C.) | | |
|---|---|---|---|---|---|
| | | | color | | |
| Sample No. | kind and ratio | contents wt. % | difference ΔE | adhesiveness of paint layers | work-ability |
| 13 | triazine | 1.0 | 7.4 | 5 | ◎ |
| 14 | | 3.0 | 4.9 | 5 | ◎ |
| 15 | | 6.0 | 4.2 | 5 | ◎ |
| 16 | benzotriazole | 1.0 | 7.9 | 5 | ◎ |
| 17 | | 3.0 | 6.1 | 5 | ◎ |
| 18 | | 6.0 | 4.6 | 5 | ◎ |
| 19 | triazine and | 1.0 | 7.1 | 5 | ◎ |
| 20 | benzotriazole | 3.0 | 5.6 | 5 | ◎ |
| 21 | at a ratio of 1:1 | 6.0 | 3.8 | 5 | ◎ |

TABLE 10

PROPERTIES OF CLEAR PAINT LAYERS OF COMPARATIVE SAMPLES

| | ultraviolet-absorbing agent | | after light-resistance test (500 hours at 63° C.) | | |
|---|---|---|---|---|---|
| | | | color | | |
| Sample No. | kind and ratio | contents wt. % | difference ΔE | adhesiveness of paint layers | work-ability |
| 9 | no addition | 0 | 22.3 | 2 | x |
| 10 | benzophenone | 1.0 | 16.5 | 3 | x |
| 11 | | 3.0 | 14.5 | 4 | Δ |
| 12 | | 6.0 | 12.4 | 4 | Δ |

EXAMPLE 5

Production of a Coated Steel Sheet for use as Transfer-printing

A galvanized steel sheet of 0.5 mm in thickness was degreased, cleaned and then chromated. Thereafter, a white polyester resin paint was applied to the sheet and baked at 220° C. for 1 minute to form a white basecoat paint layer 2 of 14 μm in dry thickness. A clear polyester resin paint was further applied to the basecoat paint layer 2 and baked at 230° C. for 1 minute to form a clear paint layer 4 of 18 μm in dry thickness.

The clear resin paint was prepared from a polyester resin (number average molecular weight of 500–20000, a glass transition temperature Tg of 10–80° C.) containing melamine at a ratio of 5–70 parts by weight on the basis of 100 parts by weight of a solid component of the resin. One or more of adipic acid, orthophthalic acid, isophthalic acid and terephthalic were added as a dicarboxylic acid monomer. Samples Nos. 1–9, 11, 13, 15, 17 and Comparative Samples Nos. 1–7 used neopentylglycol as a di-alcoholic monomer.

A triazine ultraviolet-absorbing agent together with a benzotriazole ultraviolet-absorbing agent was added to each clear paint, except Samples Nos. 9, 19 and Comparative Samples Nos. 7, 9, at a ratio of 8 wt. % based on a non-volatile component of the resin. A ratio of the triazine ultraviolet-absorbing agent to the ultraviolet-absorbing agent was adjusted to 1:1. A hindered amine photostabilizer was added to all the paints at a ratio of 1.5 wt. %.

Table 11 shows compositions of a clear paint layer 4 formed on a substrate steel sheet 1 according to the present invention, while Table 12 shows compositions of paint layers 4 of Comparative Samples.

TABLE 11

COMPOSITIONS OF CLEAR PAINT LAYERS FORMED ON STEEL SHEETS (the present invention)

| Sample No. | molecular weight | a glass transition temperature (Tg) ° C. | contents of melamine wt. % | dicarboxylic acid | addition of neopentylglycol | utraviolet-absorbing agent wt. % |
|---|---|---|---|---|---|---|
| 1 | 1000 | 35 | 70 | adipic acid: | Yes | 8 |
| 2 | 3000 | | | orthophthalic acid = 40:60 | | |
| 3 | 6000 | | | | | |
| 4 | 10000 | | | | | |
| 5 | 3000 | 22 | | | | |
| 6 | | 56 | | | | |
| 7 | | 35 | 20 | | | |
| 8 | | | 150 | | | |
| 9 | | | 70 | | | 0 |
| 10 | | | | | No | 8 |
| 11 | | | | isophthalic acid: | Yes | |
| 12 | | | | orthophthalic acid = 60:40 | No | |
| 13 | | | | terephthalic acid: | Yes | |
| 14 | | | | orthophthalic acid = 80:20 | No | |
| 15 | | | | terephthalic acid: | Yes | |
| 16 | | | | isophthalic acid = 50:50 | No | |
| 17 | | | | terephthalic acid = 100 | Yes | |

TABLE 11-continued

COMPOSITIONS OF CLEAR PAINT LAYERS FORMED ON STEEL SHEETS (the present invention)

| Sample No. | molecular weight | a glass transition temperature (Tg) ° C. | contents of melamine wt. % | dicarboxylic acid | addition of neopentylglycol | utraviolet-absorbing agent wt. % |
|---|---|---|---|---|---|---|
| 18 | | | | | No | |
| 19 | | | | | No | 0 |

TABLE 12

COMPOSITION OF CLEAR PAINT LAYERS OF COMPARATIVE SAMPLES

| Sample No. | molecular weight | a glass transition temperature (Tg) ° C. | contents of melamine wt. % | dicarboxylic acid | addition of neopentylglycol | ultraviolet-absorbing agent wt. % |
|---|---|---|---|---|---|---|
| 1 | 500 | 35 | 70 | adipic acid: | yes | 8 |
| 2 | 15000 | | | orthophthalic acid = | | 8 |
| 3 | 3000 | 15 | | 40:60 | | |
| 4 | | 70 | | | | |
| 5 | | 35 | 10 | | | |
| 6 | | | 200 | | | |
| 7 | 15000 | | 70 | | | 0 |
| 8 | | | | terephthalic acid: | no | 8 |
| 9 | | | | isophthalic acid = 50:50 | | 0 |

Transfer-Printing

A transfer film was prepared by spraying a cyanic sublimation dye ink to a whole surface of a film by an ink-jet printer. The transfer film was laid on a coated steel sheet, pressed thereto for 150 seconds at 160° C. with a pressure $4\times10^4$ Pa, and then separated therefrom.

Evaluation of Coated Steel Sheet Printed with Sublimation Dye

A test piece was cut off each Sample or Comparative Sample and offered to the same tests as mentioned above to research light-resistance, adhesiveness of a paint layer, and workability. In this Example 5, an anti-fouling property and moisture resistance was also examined as follows:

Moisture resistance was examined by a 500-hours humidity test at 49° C. regulated in JIS Z0208. After the humidity test, a surface of a paint layer was observed to detect presence or absence of blisters. Moisture resistance of the coated steel sheet was evaluated by presence (x) or absence (○) of blisters on a paint layer.

In the anti-fouling test, after red and black lines were described on a paint layer with oily inks, a test piece was left as such 24 hours at 20° C. Thereafter, the red and black inks were wiped off with methanol. A test piece, from which red and black inks were completely wiped off without any trace, was evaluated as a point 5 (excellent anti-fouling property). A point 3 represents remaining of trace a little bit, and a point 1 represents remaining of remarkable trace. If a coated steel sheet has anti-fouling property of a point 2 or more for the red ink, it is available for practical use.

Test results are shown in Table 13.

It is noted that any Sample according to the present invention was excellent in all of light-resistance, adhesiveness of a paint layer, workability, anti-scratching property, anti-fouling property and moisture resistance. Improvement of light-resistance was apparently noted in case of using orthophthalic acid and/or neopentylglycol as a monomer.

On the other hand, Comparative Samples are inferior of at least one of light-resistance, adhesiveness of a paint layer, workability, anti-fouling property, anti-scratching property and moisture resistance(Table 14). That is, Comparative Sample No. 1 was poor of adhesiveness and workability due to use of a polyester resin having relatively small molecular weight. Comparative Samples Nos. 2, 7–9 were insufficient of light-resistance due to use of a polyester resin having bigger molecular weight. Comparative Sample No. 3 had a paint layer likely to be scratched due to a lower glass transition temperature (Tg). Comparative Sample No. 4 was poor of workability due to a higher glass transition temperature (Tg). Comparative Sample No. 5 was inferior of light-resistance and anti-fouling property due to insufficient content of melamine. Comparative Sample No. 6 was poor of workability due to excessive amount of melamine.

TABLE 13

PROPERTIES OF PAINTED STEEL SHEETS

| Sample No. | a color difference ΔE after 240-hours light-resistance test | adhesiveness of a paint layer | workability | anti-scratching property | (the present invention) anti-fouling property red | black | moisture resistance |
|---|---|---|---|---|---|---|---|
| 1 | 3.5 | 5 | ○ | H | 5 | 5 | ○ |

TABLE 13-continued

PROPERTIES OF PAINTED STEEL SHEETS

| Sample No. | a color difference ΔE after 240-hours light-resistance test | adhesiveness of a paint layer | workability | anti-scratching property | (the present invention) anti-fouling property red | black | moisture resistance |
|---|---|---|---|---|---|---|---|
| 2 | 5.0 | 5 | ◎ | H | 5 | 5 | ○ |
| 3 | 5.8 | 5 | ◎ | H | 5 | 5 | ○ |
| 4 | 6.3 | 5 | ◎ | H | 4 | 5 | ○ |
| 5 | 5.5 | 5 | ◎ | H | 4 | 5 | ○ |
| 6 | 4.4 | 5 | ○ | H | 5 | 5 | ○ |
| 7 | 6.8 | 5 | ◎ | H | 4 | 5 | ○ |
| 8 | 2.9 | 5 | ○ | 2H | 5 | 5 | ○ |
| 9 | 9.7 | 5 | ◎ | H | 5 | 5 | ○ |
| 10 | 6.4 | 5 | ◎ | H | 5 | 5 | ○ |
| 11 | 5.2 | 5 | ◎ | H | 5 | 5 | ○ |
| 12 | 6.7 | 5 | ◎ | H | 5 | 5 | ○ |
| 13 | 5.5 | 5 | ◎ | H | 5 | 5 | ○ |
| 14 | 7.0 | 5 | ◎ | H | 5 | 5 | ○ |
| 15 | 6.3 | 5 | ◎ | H | 5 | 5 | ○ |
| 16 | 7.9 | 5 | ◎ | H | 5 | 5 | ○ |
| 17 | 6.5 | 5 | ◎ | H | 5 | 5 | ○ |
| 18 | 8.1 | 5 | ◎ | H | 5 | 5 | ○ |
| 19 | 9.6 | 5 | ◎ | H | 5 | 5 | ○ |

TABLE 14

PROPERTIES OF PAINTED STEEL SHEETS

| Sample No. | a color difference ΔE after 240-hours light-resistance test | adhesiveness of a paint layer | workability | anti-scratching property | (Comparative Samples) anti-fouling property red | black | moisture resistance |
|---|---|---|---|---|---|---|---|
| 1 | 3.2 | 3 | x | 2H | 5 | 5 | ○ |
| 2 | 11.0 | 5 | ◎ | F | 4 | 5 | ○ |
| 3 | 6.1 | 5 | ◎ | HB | 4 | 5 | ○ |
| 4 | 4.2 | 4 | x | 3H | 5 | 5 | ○ |
| 5 | 10.5 | 5 | ◎ | F | 3 | 4 | ○ |
| 6 | 2.6 | 5 | Δ | H | 5 | 5 | ○ |
| 7 | 13.1 | 5 | ◎ | F | 4 | 5 | ○ |
| 8 | 12.4 | 5 | ◎ | F | 4 | 5 | ○ |
| 9 | 15.3 | 5 | ◎ | F | 4 | 5 | ○ |

A painted metal sheet printed with a sublimable dye according to the present invention as above-mentioned has a transparent or translucent topcoat or clear paint layer, which enables use of metallic luster of a substrate metal sheet or a color tone of an undercoat paint layer as a background for a printed design. The painted metal sheet is also excellent in slippage-proof property and wear-resistance. A transfer-printing method using a sublimation dye is suitable for a short-lot production of colored metal sheets having designs in response to various needs. The painted metal sheet is improved in anti-scratching property and wear-resistance by dispersion of powdery silica in the topcoat or clear paint layer. The painted metal sheet is also improved in light-resistance by inclusion of melamine in a thermosetting polyester resin at a controlled ratio, so that a colored design given to the metal sheet keeps its sharpness without discoloration or fading for a long time. The metal sheets obtained in this way are useful as multi-colored signboards, decorative interior members, decorative flooring members, door panels of elevators, and surface panels of electric home appliances, surface panels of furniture.

What is claimed is:

1. A painted metal sheet, which comprises a substrate metal sheet, a topcoat or clear paint layer of 5–40 μm in thickness, formed on said substrate metal sheet, wherein said topcoat or clear paint layer is used for transfer-printing with a sublimation dye to realize a colored design and said topcoat or clear paint includes a thermosetting polyester resin and melamine, wherein said thermosetting polyester resin having number average molecular weight of 1000–10000, a glass transition temperature (Tg) of 20–60° C., and containing melamine at a ratio of 20–150 parts by weight on the basis of 100 parts by weight of a solid part of a resin.

2. The painted metal sheet of claim 1, wherein the thermosetting polyester resin includes 1,2-benzene-dicarbonyl structure derived from a dicarboxylic acid monomer in its molecule.

3. The painted metal sheet of claim 1, wherein the thermosetting polyester resin includes 2,2-dimethyl trimethylene structure derived from di-alcoholic monomer in its molecule.

4. The painted metal sheet of claim 1, wherein the topcoat or clear paint layer contains a component selected from the group consisting of triazine ultraviolet-absorbing agents and benzotriazole ultraviolet-absorbing agents.

5. The painted metal sheet of claim 1, further comprising an undercoat paint layer formed between said substrate metal sheet and said topcoat or clear paint layer.

6. The painted metal sheet of claim 1, further comprising a primer paint layer formed between said substrate metal sheet and said topcoat or clear paint layer.

7. The painted metal sheet of claim 1, wherein the topcoat or clear paint layer is transparent.

8. The painted metal sheet of claim 1, wherein the topcoat or clear paint layer is translucent.

* * * * *